US006485244B1

(12) United States Patent
McKinney

(10) Patent No.: US 6,485,244 B1
(45) Date of Patent: Nov. 26, 2002

(54) DUAL TRACK ASSEMBLY FOR REFUSE COLLECTION EQUIPMENT

(75) Inventor: Bobby McKinney, Fort Payne, AL (US)

(73) Assignee: The Heil Company, Fort Payne, AL (US)

( * ) Notice: Subject to any disclaimer, the term of this patent is extended or adjusted under 35 U.S.C. 154(b) by 0 days.

(21) Appl. No.: 09/917,418

(22) Filed: Jul. 28, 2001

(51) Int. Cl.[7] ..... B65F 3/00
(52) U.S. Cl. ..... 414/525.52; 414/513; 214/83.3
(58) Field of Search ..... 414/525, 513; 214/83.3

(56) References Cited

U.S. PATENT DOCUMENTS

| | | | | |
|---|---|---|---|---|
| 2,649,216 A | | 8/1953 | Gollnick | |
| 3,143,230 A | | 8/1964 | Gollnick | |
| 3,402,837 A | | 9/1968 | Palmer et al. | |
| 3,615,029 A | | 10/1971 | Anderson | |
| 3,662,908 A | * | 5/1972 | Boda | 214/83.3 |
| 3,682,336 A | | 8/1972 | Wieschel et al. | |
| 3,696,951 A | | 10/1972 | Toppins et al. | |
| 3,797,680 A | | 3/1974 | Dennis | |
| 3,899,091 A | | 8/1975 | Smith | |
| 4,180,365 A | * | 12/1979 | Herpich et al. | 414/525.52 |
| 4,955,776 A | | 9/1990 | Dahlin | |
| 5,478,188 A | | 12/1995 | Rea et al. | |
| 5,971,694 A | * | 10/1999 | McNeilus et al. | 414/525.52 |

* cited by examiner

*Primary Examiner*—Kathy Matecki
*Assistant Examiner*—Charles Fox
(74) *Attorney, Agent, or Firm*—Chambliss, Bahner & Stophel, P.C.

(57) ABSTRACT

A dual track handling assembly is provided for refuse collection equipment having a hopper for receiving refuse, which hopper is defined in part by a pair of oppositely disposed sidewalls. The assembly includes a pair of lower tracks, each of which is mounted on a sidewall in a generally parallel disposition to the other. The assembly also includes a pair of upper tracks each of which is mounted on a sidewall in a generally parallel disposition to the other. The pair of lower tracks define a plane that is substantially parallel to a plane defined by the pair of upper tracks. The assembly also includes a pair of lower track shoes which move in the lower tracks and a pair of upper track shoes which move in the upper tracks. The assembly also includes a carrier having a lower track end that is attached to a lower track shoe, an upper track end that is attached to an upper track shoe, and a lower side that is substantially parallel to the tracks within which said lower and upper track shoes are received. The assembly also includes a blade that pivots between an open position and a closed position, a blade actuator, and a packer actuator that moves the upper track shoes in the upper tracks. The assembly also includes a deflector that is substantially parallel to the plane defined by the pair of lower tracks. The lower side of the carrier is adapted to substantially bear against at least a portion of the deflector.

14 Claims, 10 Drawing Sheets

FIGURE 8
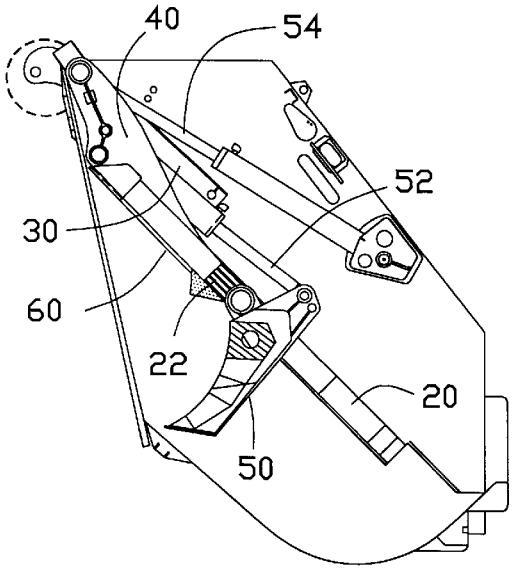
FIGURE 9
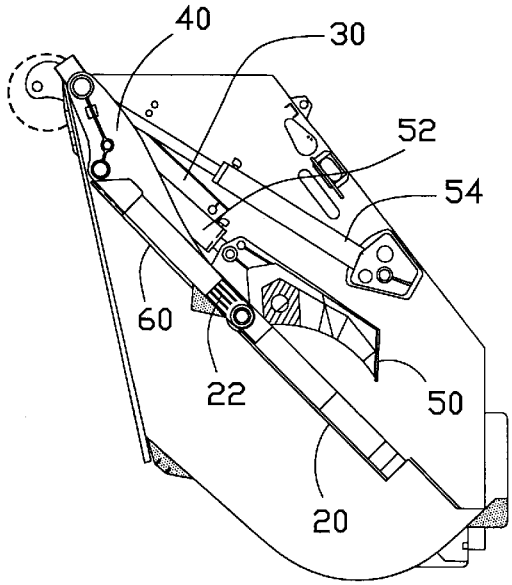
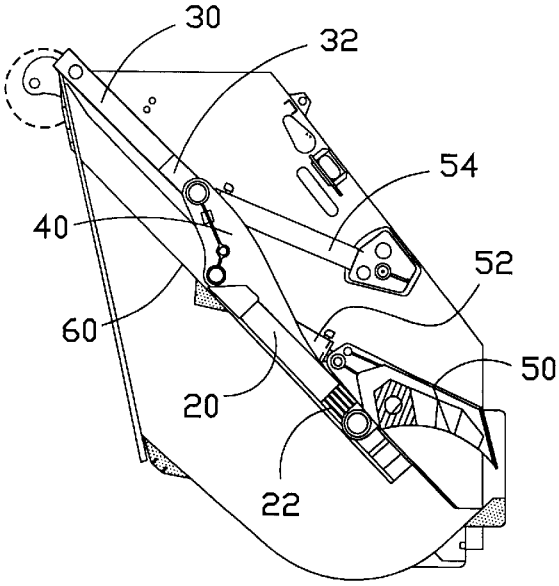
FIGURE 10
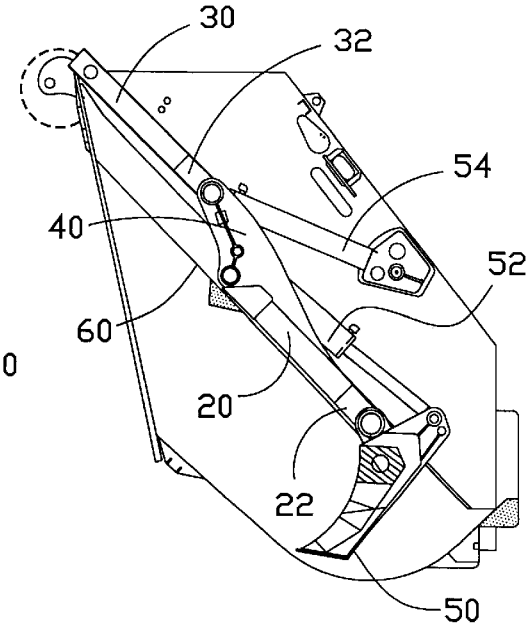
FIGURE 11

FIGURE 12
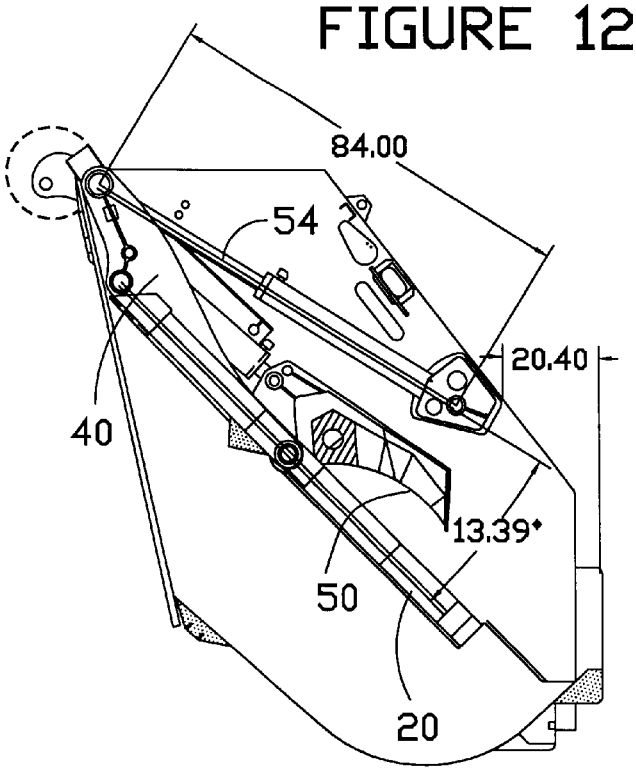
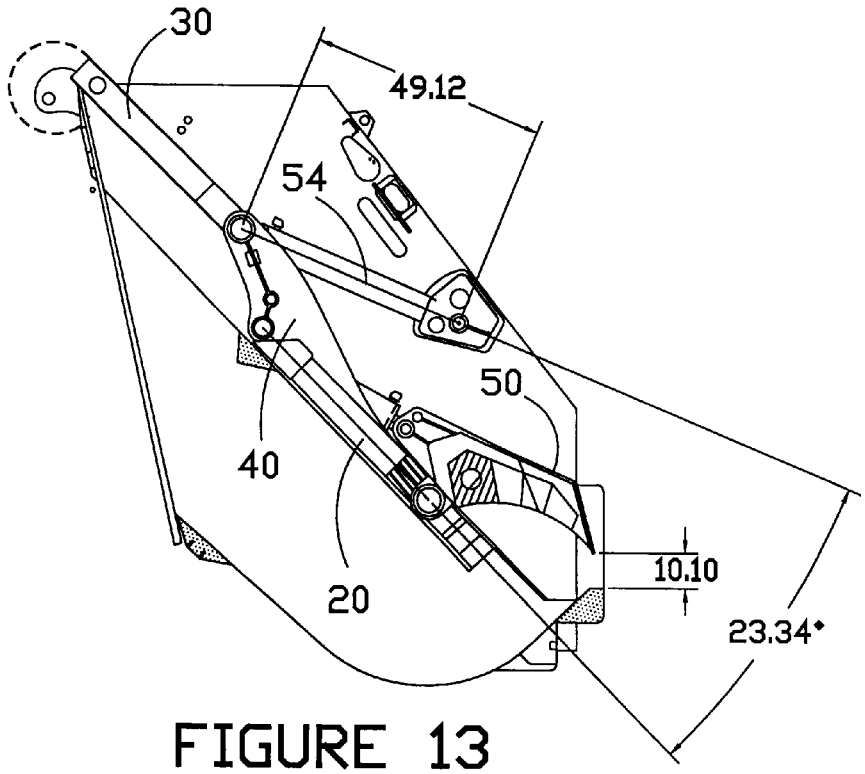
FIGURE 13

DUAL TRACK ASSEMBLY FOR REFUSE COLLECTION EQUIPMENT

FIELD OF THE INVENTION

This invention relates generally to devices for moving refuse in refuse collection equipment. More particularly, this invention relates to an improved assembly for moving and packing refuse in an item of refuse collection equipment such as a rear-loading truck.

BACKGROUND AND DESCRIPTION OF THE PRIOR ART

Many different devices have been used to move refuse from a hopper that is adapted to receive refuse to a storage compartment of a refuse collection truck. Typically, these assemblies comprise a blade for packing refuse, a carrier for moving the blade from an extended to a retracted position, and hydraulic cylinders for moving the carrier and the blade. These conventional assemblies, however, all suffer from a variety of disadvantages. For example, several conventional assemblies use a complicated system of links or links and tracks to move the blade from an open position to a closed position or from an extended to a retracted position. See, e.g., U.S. Pat. Nos. 2,619,216; 3,402,837; 3,681,336; 3,696,951; 3,899,091; and 5,478,188. These assemblies, however, are complicated, costly, and difficult to assemble and disassemble.

Other assemblies have used a pair of single straight tracks to guide the movement of the carrier and the blade. See, e.g., U.S. Pat. Nos. 3,143,230; 3,615,029; and 3,797,680. These assemblies, however, increase the horizontal displacement of the assembly (e.g., the length of the overhang on a refuse truck) and the frictional forces and stress exerted on the track. Also, the single straight track assemblies do not provide the sidewalls of the refuse collection equipment with an optimal amount of structural integrity. In addition, the packer actuator and the track of the single straight track assemblies are not in substantial alignment. As a result, these assemblies tend to direct refuse towards the roof of the storage compartment, and they do not efficiently utilize the force exerted by the packer actuator. Finally, the single straight track assemblies limit the span between the lower shoe of the carrier and the upper shoe of the carrier, thereby increasing the localized stress experienced by the track and the shoes.

Still other assemblies have hydraulic actuators that are mounted outside the sidewall of the refuse collection equipment. See, e.g., U.S. Pat. No. 3,899,091. These assemblies also suffer from disadvantages. Most notably, these assemblies require a slot in the sidewall of the refuse collection equipment in order to connect the hydraulic actuating cylinders to the carrier. The slots in the sidewalls of the equipment allow refuse to pass from the hopper or the storage compartment to the assembly components. This results in damage to the assembly components and may result in the unintentional discharge of refuse through the sidewalls.

Other assemblies have a reciprocating deflector for deflecting refuse from the assemblies. See, e.g., U.S. Pat. No. 3,696,951. These assemblies also suffer from disadvantages. First, these deflectors require complicated and costly reciprocating devices. Often, these deflectors require additional bracing or reinforcement. In addition, these reciprocating deflectors are not adapted to cooperate with the carrier to provide resistance against the forces exerted by packed refuse.

It would be desirable, therefore, if a refuse handling assembly for refuse collection equipment could be provided to pack refuse more efficiently and inexpensively. It would also be desirable if such an assembly could be provided that would reduce the frictional forces and stress experienced by components of the assembly while increasing the structural integrity of the refuse collection equipment. It would also be desirable if such an assembly could be provided that minimizes the exposure of the components of the assembly to refuse and minimizes the unintentional release of refuse from the equipment. It would also be desirable if such an assembly could be provided whereby the hydraulic actuators of the assembly are arranged such that they extend during the packing process. It would also be desirable if such an assembly could be provided that would permit the use of smaller, lighter, less expensive hydraulic actuators to obtain the same packing force as larger, heavier, more expensive actuators used in conventional assemblies. It would also be desirable if such an assembly could be provided to reduce the cycle time of the refuse packing procedure. It would also be desirable if such an assembly could be provided to reduce the horizontal displacement or overhang of the assembly. It would also be desirable if such an assembly could be provided with an increased span between its upper and lower shoe in order to reduce the stress experienced by the components of the assembly. It would also be desirable if such an assembly could be provided that would be easier to assemble, disassemble, maintain and repair.

ADVANTAGES OF THE INVENTION

Accordingly, it is an advantage of the invention to provide a dual track assembly for refuse collection equipment that may pack refuse more efficiently and inexpensively. It also an advantage of the invention to provide an assembly that reduces the frictional forces and stress experienced by the components of the assembly while increasing the structural integrity of the refuse collection equipment. It is also an advantage of the invention to provide an assembly that minimizes the exposure of the components of the assembly to refuse and minimizes the unintentional release of refuse from the equipment. It is another advantage of a preferred embodiment of the invention to provide an assembly having hydraulic actuators that are arranged such that they extend during the packing process. It is still another advantage of the invention to provide an assembly that would permit the use of smaller, lighter, less expensive hydraulic actuators to obtain the same packing force as larger, heavier, more expensive actuators used in conventional assemblies. It yet another advantage of the invention to provide an assembly that reduces the cycle time of the refuse packing procedure. It is another advantage of the invention to provide an assembly that reduces the horizontal displacement of the assembly. It is also an advantage of the invention to provide an assembly having an increased span between its upper and lower shoe in order to reduce the stress experienced by the components of the assembly. It is yet another advantage of the invention to provide an assembly that is easier to assemble, disassemble, maintain and repair.

Additional objects and advantages of this invention will become apparent from an examination of the drawings and the ensuing description.

EXPLANATION OF TECHNICAL TERMS

As used herein, the term "hopper" refers to that portion of a refuse collection device into which refuse may be deposited.

As used herein, the term "storage compartment" refers to that portion of a refuse collection device into which refuse may be pushed by a blade from the hopper.

As used herein, the term "front", when used in reference to a vehicle, refers to the end of the vehicle where the cab is located.

As used herein, the term "rear", when used in reference to a vehicle, refers to the end of the vehicle opposite the front end.

As used herein, the term "sidewall", when used in reference to a refuse collection device, refers to a side of the storage compartment and/or hopper that is generally parallel to the direction of movement of the blade. The "sidewalls" of a storage compartment may be contiguous with side walls of an adjacent hopper.

As used herein, the term "shoe", when used in reference to the invention, refers to a wheel mounted on an axle or a shoe or slide that is adapted to move with minimal resistance along the tracks.

SUMMARY OF THE INVENTION

The invention comprises a dual track handling assembly for refuse collection equipment having a hopper for receiving refuse. The hopper is defined in part by a first sidewall and an oppositely disposed second sidewall. The assembly comprises a first lower track and a second lower track. Each of the lower tracks has a first end, a second end and a longitudinal axis. The first lower track is mounted on the first sidewall of the hopper, and the second lower track is mounted on the second sidewall of the hopper. The lower tracks are mounted so that the longitudinal axis of the first lower track is generally parallel to the longitudinal axis of the second lower track. The assembly also comprises a first upper track and a second upper track. Each of the upper tracks has a first end, a second end and a longitudinal axis. The first upper track is mounted on the first sidewall of the hopper, and the second upper track is mounted on the second sidewall of the hopper. The upper tracks are mounted so that the longitudinal axis of the first upper track is generally parallel to the longitudinal axis of the second upper track. The longitudinal axes of the first and second lower tracks define a plane that is substantially parallel to a plane defined by the longitudinal axes of the first and second upper tracks.

The assembly also comprises a first lower track shoe which is adapted to be received in the first lower track and to move between the first end and the second end of the first lower track, and a second lower track shoe which is adapted to be received in the second lower track and to move between the first end and the second end of the second lower track. In addition, the assembly comprises a first upper track shoe which is adapted to be received in the first upper track and to move between the first end and the second end of the first upper track, and a second upper track shoe which is adapted to be received in the second upper track and to move between the first end and the second end of the second upper track.

The assembly also comprises a carrier having a lower track end that is attached to a lower track shoe, an upper track end that is attached to an upper track shoe, and a lower side that is substantially parallel to the longitudinal axes of the lower and upper tracks within which the lower and upper track shoes are received. The carrier is adapted to maintain a fixed spaced relationship between the upper track shoe and the lower track shoe as the shoes move in their respective tracks. A blade is pivotally connected to the carrier. The blade is adapted to pivot between an open position and a closed position. A packer actuator is adapted to move the upper track shoes between the first and second ends of their respective upper tracks. A blade actuator is connected to the blade and adapted to pivot the blade between the open position and the closed position. A deflector is mounted between the sidewalls of the hopper so as to be substantially parallel to the plane defined by the longitudinal axes of the first and second lower tracks. The lower side of the carrier is adapted to substantially bear against at least a portion of the deflector when the lower track shoe that is attached to the lower track end moves from the first end of the lower track within which said lower track shoe is received to the second end of the lower track.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which:

FIG. 8 is a side view of the preferred embodiment of the invention, with the second sidewall removed, illustrating the assembly in a raised position and the blade in a closed position.

FIG. 9 is a side view of the preferred embodiment of the invention, with the second sidewall removed, illustrating the assembly in a raised position and the blade in an open position.

FIG. 10 is a side view of the preferred embodiment of the invention, with the second sidewall removed, illustrating the assembly in a lowered position and the blade in an open position.

FIG. 11 is a side view of the preferred embodiment of the invention, with the second sidewall removed, illustrating the assembly in a lowered position and the blade in a closed position.

FIG. 12 is a side view of the preferred embodiment of the invention, with the second sidewall removed, illustrating the horizontal displacement of the assembly and the angle between the packer actuator and the lower track when the assembly is in a raised position.

FIG. 13 is a side view of the preferred embodiment of the invention, with the second sidewall removed, illustrating the angle between the packer actuator and the lower track when the assembly is in a lowered position.

DESCRIPTION OF THE PREFERRED EMBODIMENTS OF THE INVENTION

Figure 1:
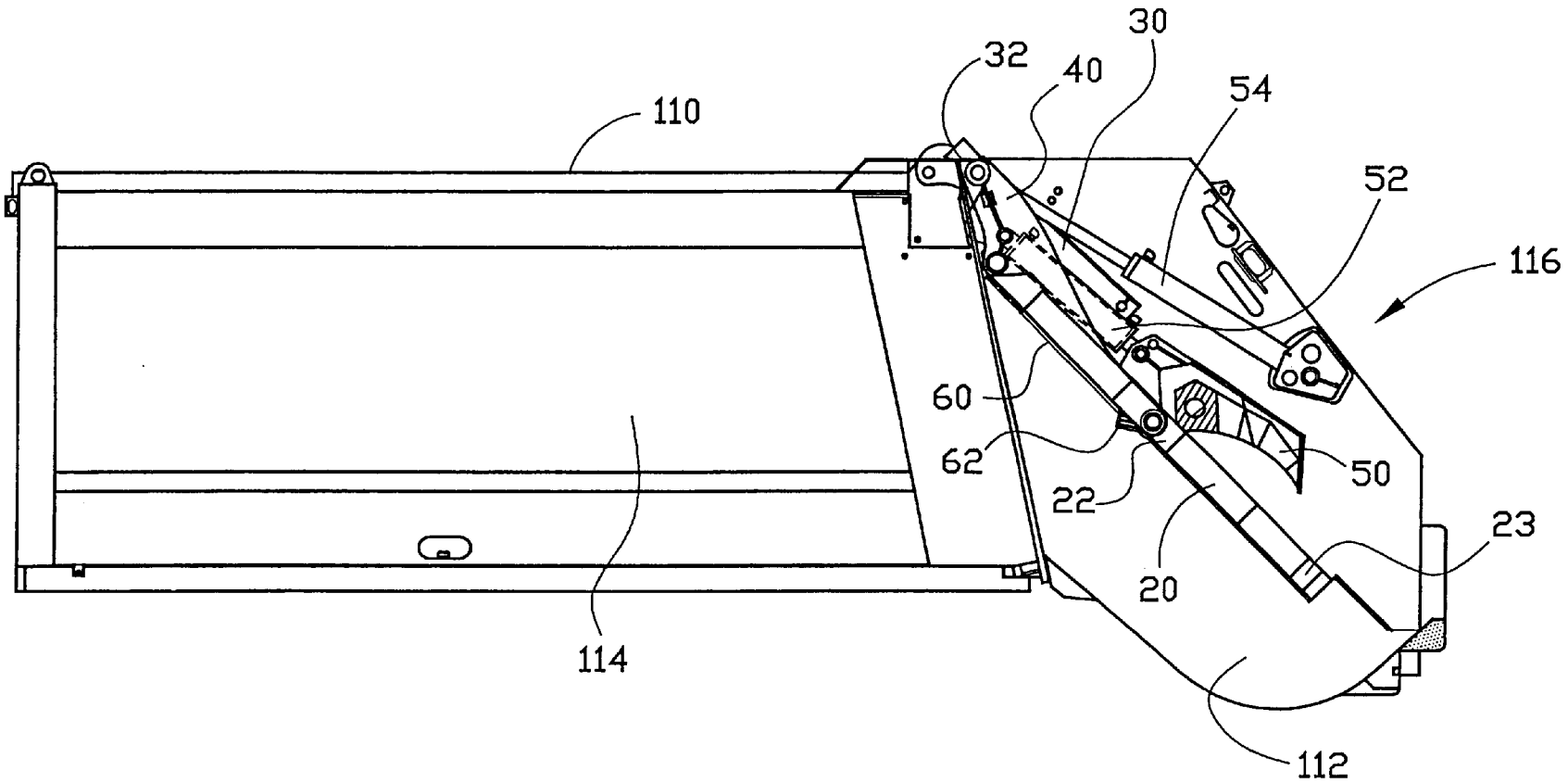
FIG. 1 is a side view of the preferred embodiment of the invention mounted on the rear of a rear-loading refuse truck, with the second sidewall removed for clarity.
Figure 2:
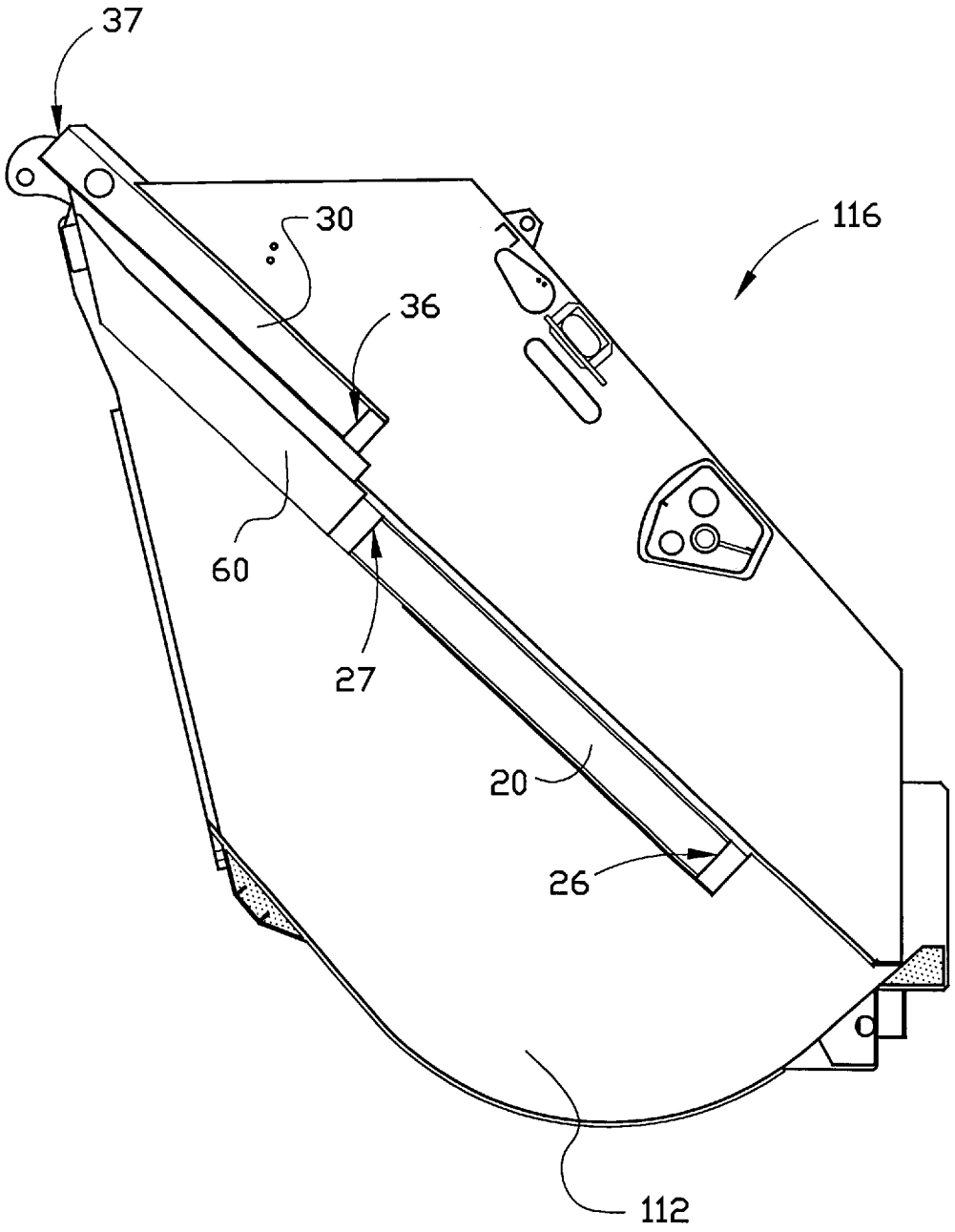
FIG. 2 is a side view of the first sidewall of the hopper of the embodiment of the invention illustrated in FIG. 1.

Referring now to the drawings, the preferred embodiments of the dual track handling assembly of the invention are illustrated in FIGS. 1 through 13. As illustrated in FIGS. 1, 2 and 4–7, the preferred embodiment of the assembly of the invention is adapted for use on rear-loading refuse collection truck 110 having first sidewall 112, a second sidewall 113 opposite the first sidewall (partially shown in FIG. 7), storage compartment 114, and hopper 116. The invention is adapted to move refuse from the hopper to the storage compartment of the truck. The preferred assembly comprises first lower track 20 on first sidewall 112, a second lower track on the second sidewall (not shown in FIG. 1), first lower track shoe 22 in first lower track 20, a second lower track shoe in the second lower track (not shown), first upper track 30 in first sidewall 112, a second upper track in the second sidewall (not shown), first upper track shoe 32 in first upper track 30, a second upper track shoe in the second upper track (not shown), first carrier 40, blade 50, blade actuator 52, packer actuator 54, and deflector 60.

First lower track 20 and the second lower track are substantially identical except that the first lower track is mounted on first sidewall 112 and the second lower track is mounted on the second sidewall. The lower tracks may be any suitable conventional tracks defined by a channel, slot, groove or the like. The preferred lower track is an open structural steel channel mounted on a sidewall of the refuse collection truck. The lower tracks are adapted to guide the movement of the lower track shoes along longitudinal axis 24 of the first lower track 20 and longitudinal axis 25 (see FIG. 7) of the second lower track. The lower tracks are arranged so that longitudinal axis 24 of first lower track 20 is generally parallel to longitudinal axis 25 of the second lower track. First lower track 20 has first end 26 and second end 27, and the second lower track has a corresponding first end and a second end (not shown). In the preferred embodiment of the invention, the first lower track 20 is provided with removably attached face plate 28, and the second lower track is also provided with a removably attached face plate. The face plates may be any suitable conventional device adapted to be removably attached to the lower tracks such as sheet metal, structural steel, plastomeric materials and the like.

First upper track 30 and the second upper track are also substantially identical except that first upper track is mounted on first sidewall 112 and second upper track is mounted on the second sidewall (not shown in FIG. 1). The upper tracks may be any suitable conventional tracks defined by a channel, slot, groove, tube, cylinder or the like. The preferred upper track is a substantially closed structural steel channel mounted on a sidewall of the refuse collection truck. First upper track 30 is adapted to guide the movement of first upper track shoe 32 along longitudinal axis 34 and the second upper track is adapted to guide the movement of the second upper track shoe along longitudinal axis 35 (see FIG. 7) of the second upper track. First upper track 30 has first end 36 and second end 37, and the second upper track also has a first end and a second end. The upper tracks are arranged so that longitudinal axis 34 of first upper track 30 is generally parallel to longitudinal axis 35 of the second upper track. The preferred upper tracks substantially enclose the upper track shoes so as to prevent the upper track shoes from being exposed to refuse. In the preferred embodiment of the assembly, the first ends of the upper tracks are open.

The lower tracks and the upper tracks are substantially parallel to each other. As a result, the longitudinal axes of the lower tracks and the longitudinal axes of the upper tracks are also substantially parallel to each other, and the lower track shoes and the upper track shoes move along substantially parallel paths. In addition, the longitudinal axes of the first and second lower tracks define a plane that is substantially parallel to a plane defined by the longitudinal axes of the first and second upper tracks. Furthermore, the longitudinal axes of the upper tracks are preferably disposed rearwardly and upwardly from the longitudinal axes of the lower tracks. As a result, the plane defined by the longitudinal axes of the upper tracks is not coplanar with the plane defined by the longitudinal axes of the lower tracks. The rearward and upward disposition of the preferred upper tracks relative to the lower tracks produces several structural and functional advantages. First, the offset disposition of the upper and lower tracks results in improved structural integrity, rigidity and strength in the sidewalls of the refuse collection equipment. Second, the rearward and upward disposition of the preferred upper tracks relative to the lower tracks results in reduced stress in the structural components of the assembly because the distance between the upper and lower track shoes is increased.

Figure 3:
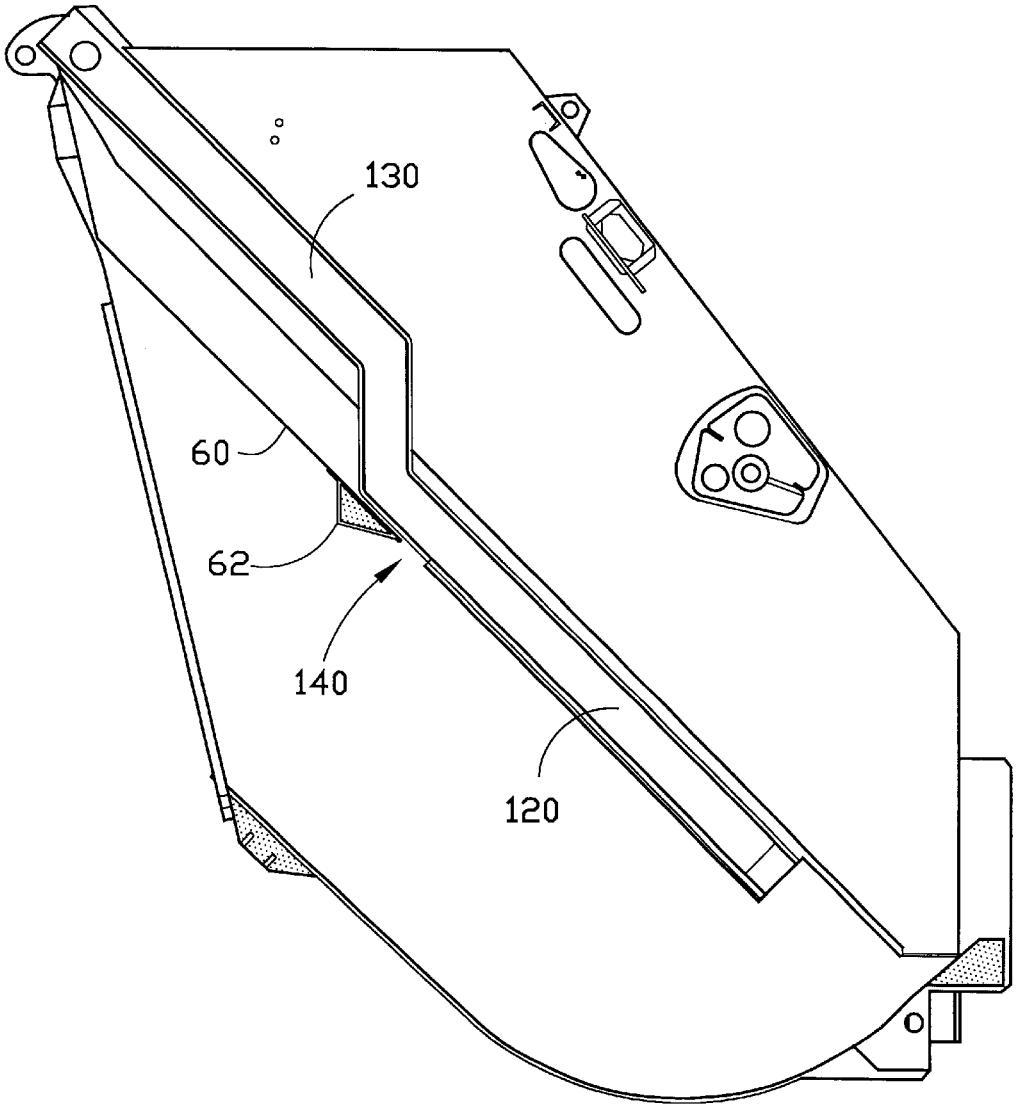
FIG. 3 is a side view of an alternative embodiment of the first sidewall of the hopper of the invention.
Figure 4:
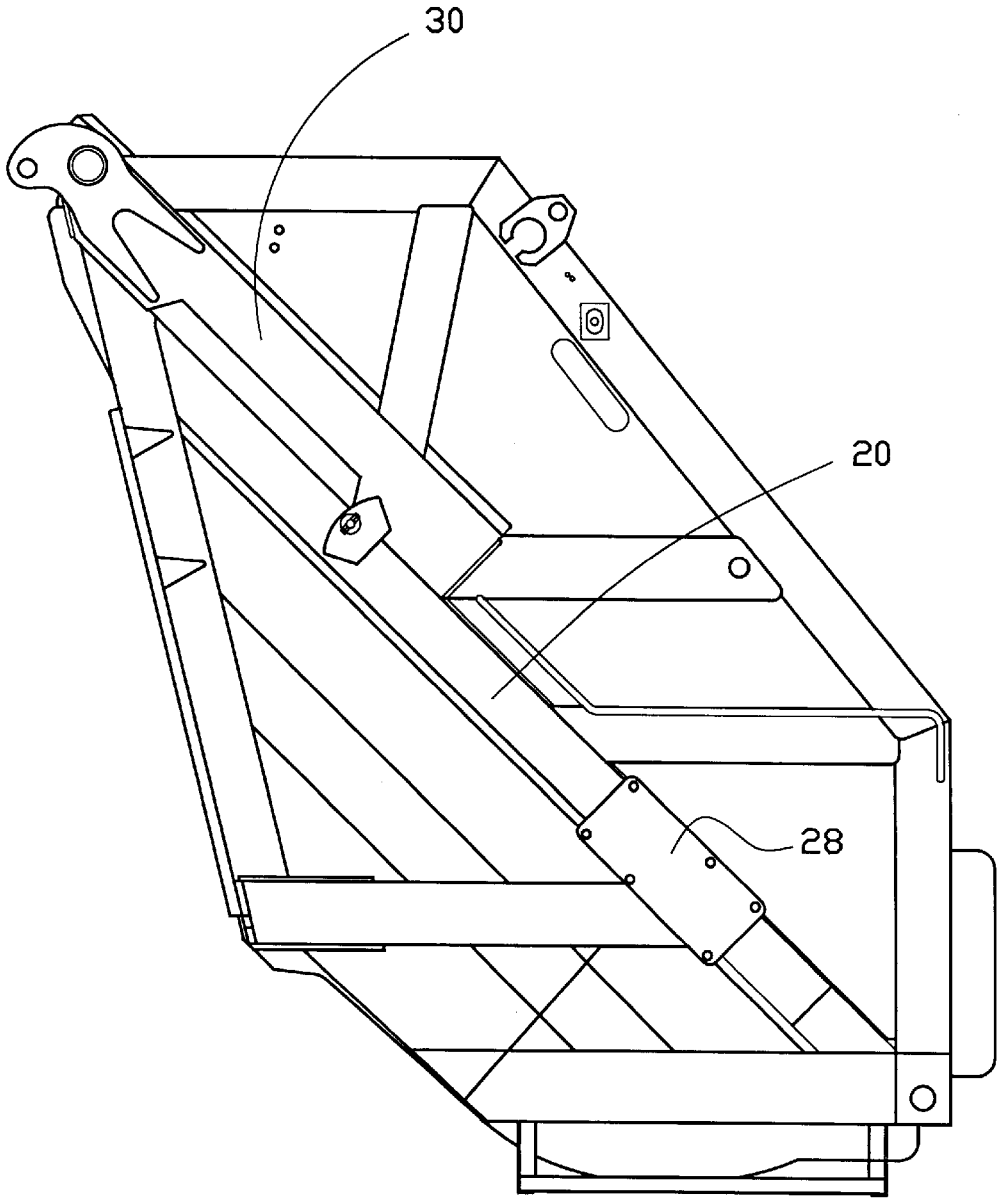
FIG. 4 is a side view of the exterior of the hopper of the embodiment of the invention illustrated in FIG. 1.

As illustrated in FIG. 3, it is also contemplated within the scope of the invention that the upper track and the lower track on a sidewall may comprise a single continuous track 140 having an upper portion 130 and a lower portion 120 with each portion having a longitudinal axis that is parallel to, but not coincident with the longitudinal axis of the other portion.

First lower track shoe 22, second lower track shoe 23 (see FIG. 7), first upper track shoe 32 and second upper track shoe 33 (see FIG. 7) may be comprised of any suitable conventional devices adapted to be received by and move along tracks defined by channels, grooves, slots, tubes, cylinders and the like. First lower track shoe 22 is adapted to be received by and move along first lower track 20. Second lower track shoe 23 is adapted to be received by and move along the second lower track. First upper track shoe 32 is adapted to be received by and move along first upper track 30. Second upper track shoe 23 is adapted to be received by and move along the second upper track. The movement of first lower track shoe 22 and first upper track shoe 32 is guided by first lower track 20 and first upper track 30, respectively. The movement of the second lower track shoe and the second upper track shoe is guided by the second lower track and the second upper track, respectively. Thus, first lower track shoe 22 moves along the longitudinal axis of first lower track 20, and first upper track shoe 32 moves along the longitudinal axis of first upper track 30. Similarly, second lower track shoe 23 moves along the longitudinal axis of the second lower track and second upper track shoe 33 moves along the longitudinal axis of the second upper track. As a result, first lower track shoe 22 and first upper track shoe 32 move along substantially parallel paths of travel, but their paths of travel are not coplanar. In a preferred embodiment of the invention, the upper track shoes are substantially enclosed in the upper tracks. As a result, the upper track shoes are not exposed to refuse.

The lower track shoes and the upper track shoes may be provided with wear plates adapted to reduce the frictional force between the shoes and the tracks. Furthermore, the shoes may be provided in the form of rollers (not shown) that are adapted to be received by and move along the tracks.

Figure 5:
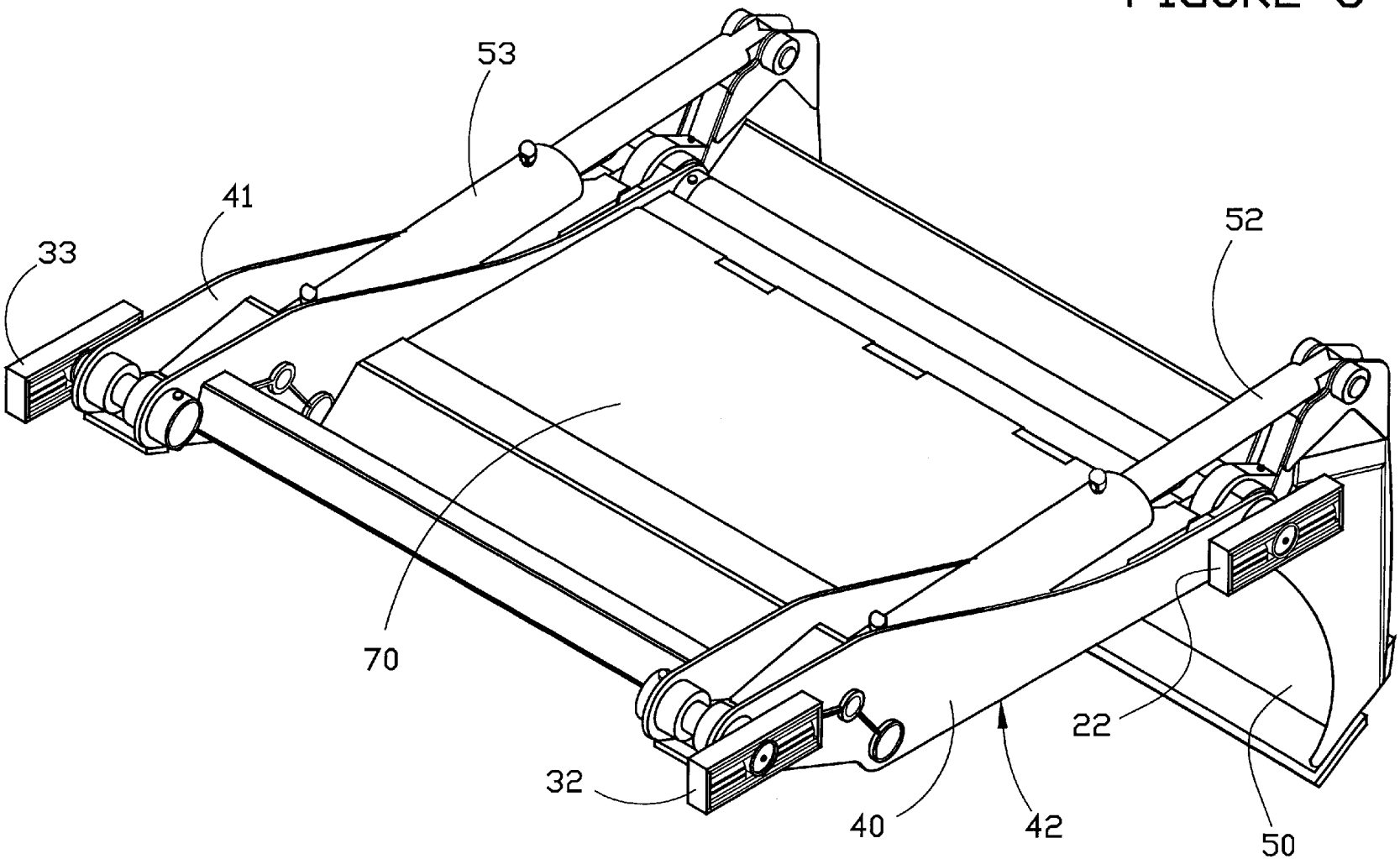
FIG. 5 is a perspective view of several of the components of the embodiment of the invention illustrated in FIG. 1.
Figure 6:
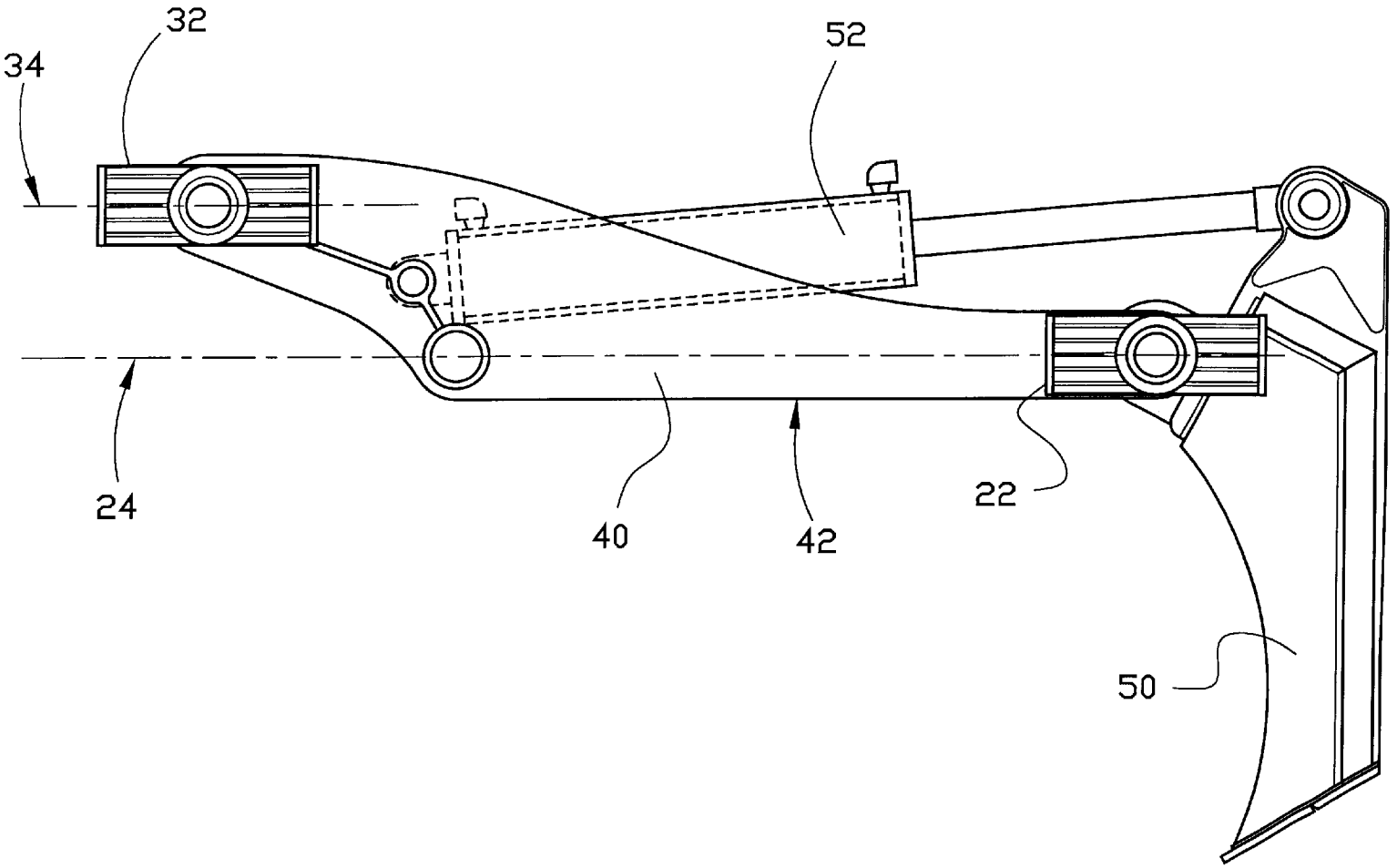
FIG. 6 is a side view of several of the components of the embodiment of the invention illustrated in FIG. 1.
Figure 7:
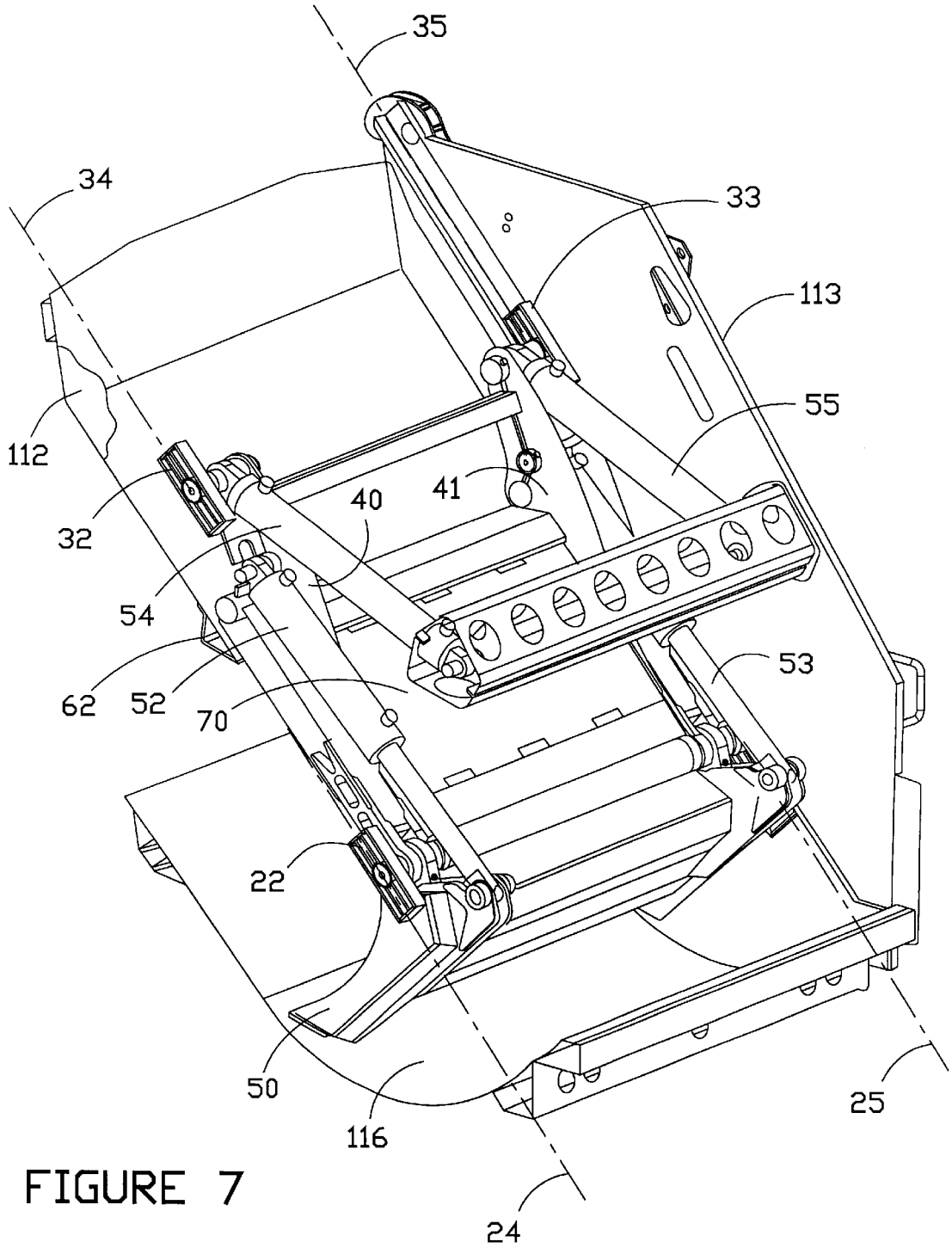
FIG. 7 is a perspective view of most of the components of the embodiment of the invention illustrated in FIG. 1.

First carrier 40 and second carrier 41 (see FIG. 5) are substantially identical except that first carrier 40 is attached to first lower track shoe 22, first upper track shoe 32, and first blade actuator 52 while second carrier 41 is attached to second lower track shoe 23, second upper track shoe 33, and second blade actuator 53. First carrier 40 has first lower track end 44 and that is attached to first lower track shoe 22, and first upper track end 46 that is attached to first upper track shoe 32. First carrier 40 also has first lower side 42 that is substantially parallel to the longitudinal axes of the lower and upper tracks within which the lower and upper track shoes are received. First lower side 42 of first carrier 40 is adapted to substantially bear against at least a portion of deflector 60 when the first lower track shoe that is attached to the first lower end moves from the first end of the first lower track to the second end of the first lower track. First carrier 40 is adapted to maintain a fixed spaced relationship between the upper track shoes and the lower track shoes as the shoes move in their respective tracks. As a result, carrier 40 moves along a path of travel parallel to the longitudinal axes of the upper and lower tracks. Carrier 40 may be made from any suitable conventional material such as structural steel or the like. As shown in FIG. 5, the preferred carriers comprise a pair of plates between which the blade actuators are situated. While FIG. 5 illustrates a pair of carriers, it is also contemplated that the assembly may comprise only one carrier or more than two carriers.

Blade 50 is pivotally attached to first carrier 40 and adapted to move between an open position and a closed position. Blade 50 may be any suitable conventional blade used in tailgate assemblies for refuse collection equipment such as rear-loading refuse collection trucks. Blade 50 is also pivotally connected to first blade actuator 52 and second blade actuator 53 (see FIG. 7). First blade actuator 52 and second blade actuator 53 are substantially identical except that first blade actuator is attached to first carrier 40 and second blade actuator 53 is attached to second carrier 41. The blade actuators extend and retract to move blade 50 between the open and closed positions. The preferred first blade actuators are mounted to the refuse collection truck so that they extend when blade 50 is moved from the open to the closed position. The preferred blade actuators are also mounted so that they are in substantial alignment with the longitudinal axes of the upper and lower tracks. In a preferred embodiment of the invention, pressure gauge 58 is in fluid communication with first blade actuator 52 and adapted to determine the pressure level in first blade actuator 52. First blade actuator 52 may be any suitable conventional hydraulic actuator. While FIG. 5 illustrates a pair of blade actuators, it is also contemplated within the scope of the invention that only one or more than two blade actuators may be used.

Preferred first packer actuator 54 and second packer actuator 55 are substantially identical to each other except that first packer actuator 54 is pivotally attached to first upper track shoe 32 and first carrier 40 and second packer actuator is pivotally attached to second upper track shoe 33 and second carrier 41. First packer actuator 54 is adapted to move first upper track shoe 32 between the first end and the second end of the first upper track 30. Second packer actuator is adapted to move second upper track shoe 33 between the first end and the second end of the second upper track 31. The preferred packer actuators are mounted to the refuse collection truck so that the actuators extend when the upper track shoes are moved from first ends of the upper tracks towards second ends of the upper tracks. The preferred packer actuators are also mounted so that the actuators are in substantial alignment with the longitudinal axes of the upper and lower tracks. The packer actuators may be any suitable conventional hydraulic cylinders; however, because the packer actuators of the invention may be mounted in substantial alignment with the longitudinal axes of the upper and lower tracks, a smaller, lighter and faster hydraulic cylinder may used to obtain the same packing force of a larger, heavier and slower hydraulic cylinder used in a conventional single-track assembly. In addition, the substantial alignment of the packer actuators and the upper and lower tracks results in reduced frictional forces between the upper shoes and the upper tracks. While FIG. 5 illustrates a pair of packer actuators, it is also contemplated within the scope of the invention that only one or more than two packer actuator may be used.

Deflector 60 is adapted to direct refuse into the storage compartment of the refuse collection equipment and away from the components of the assembly of the invention. Deflector 60 may be made from any suitable conventional material such as sheet metal or the like. Deflector 60 is mounted between the sidewalls of the hopper of the refuse collection truck so that it is substantially parallel to the plane defined by the longitudinal axes of the first and second lower tracks. Deflector 60 may be mounted using any suitable conventional means such as welding, threaded fasteners, rivets and the like.

In the preferred embodiment of the invention illustrated in FIG. 5, support plate 70 is mounted between the first carrier and the second carrier so that said support plate is substantially parallel to the deflector. The support plate provides strength and support for the carriers. In addition, at least a portion of deflector 60 is adapted to substantially bear against the lower side of the carrier when the lower track shoe that is attached to the lower track end moves from the first end of the lower track within which the lower track shoe is received to the second end of the lower track. This substantial bearing relationship between deflector 60 and lower side of the carrier results in several advantages. First, the deflector may be lighter than conventional deflectors because a portion of the force exerted on the deflector by packing refuse may be transferred to the carrier. In other words, the carrier provides structural support to the deflector. As a result, the deflector of the assembly of the invention does not require complicated and costly bracing or reinforcement. In addition, the deflector of the assembly of the invention may be fixed as opposed to more complicated and costly reciprocating deflectors. In a preferred embodiment of the invention, baffle 62 is mounted on deflector 60 so as to direct refuse towards the storage compartment and away from the assembly. Baffle 62 may be any suitable conventional baffle adapted to direct refuse, and baffle 62 may be mounted to deflector 60 by any suitable conventional means such as welding, threaded fasteners, rivets and the like.

In operation, several advantages of the preferred assembly of the invention are realized. When the packer actuator is extended, the upper track shoes move from the first end to the second end of the upper tracks. The blade actuator is then retracted so as to move the blade from the closed position to the open position. In this position, the hopper of the refuse collection equipment is able to receive refuse. After refuse has been placed in the hopper and while the blade is in the open position, the packer actuator is retracted and the upper track shoes move from the second upper end of the upper tracks to the first end. When the upper track shoes move to the first end of the upper tracks, the blade actuator is extended so as to pivot the blade from the open position to the closed position. As the blade pivots between the open and the closed position, it exerts a pushing force on the refuse collected in the hopper. While the blade is in the closed position, the packer actuator extends so as to move the upper track shoes from the first end of the upper tracks to the second end. As the shoes moves along the tracks, the blade exerts a pushing force on the refuse in the direction towards the storage compartment of the refuse collection equipment. The deflector assists in directing the refuse towards the storage compartment and away from the handling assembly. Also, as the upper shoes move from the first end of the upper tracks to the second end, the bottom side of the carrier substantially bears against the deflector, thereby providing structural support to the deflector as the deflector experiences forces from the packed refuse. When the upper track shoe reaches the second end of the upper track, the cycle may be repeated.

A complete cycle of the dual track assembly of the invention is illustrated in FIGS. 8 through 11. During the cycle, the blade moves from a closed position (FIG. 8), to an open position (FIG. 9) and back to a closed position (FIG. 11). The carrier moves from a raised position (FIG. 8), to a lowered position (FIG. 10), and back to a raised position (FIG. 8).

Figure 14:
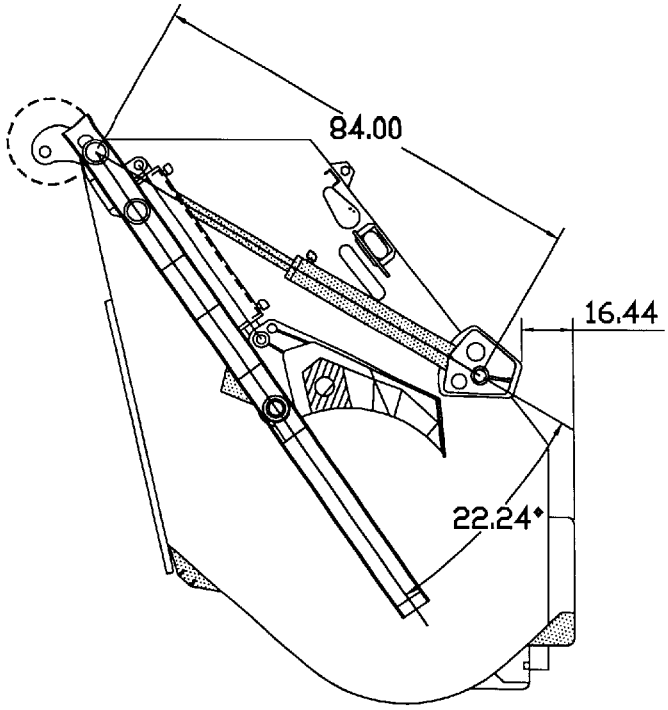
PRIOR ART FIGURE 14
FIG. 14 is a side view of a prior art single track assembly, with the second sidewall removed, illustrating the increased horizontal displacement of the assembly and the increased angle between the packer actuator and the track as compared to the preferred embodiment of FIG. 12.

FIGS. 12 through 15 illustrate some of the advantages of the dual track assembly of the invention as compared to similar conventional straight single-track assemblies. As illustrated in FIGS. 12 and 14, the blade is in an open position and the carrier in a raised position. The span between the ends of the packer actuator is the same in both Figures. The horizontal displacement of the two assemblies is different, however, as reflected by the distance between the rear end of the truck and the lower end of the packer actuator. In addition, the angle between the packer actuator and the tracks is different. As shown in the Figures, the packer actuator of the dual track assembly of the invention is in substantially closer alignment to the tracks than the packer actuator of the prior art single-track assembly.

Figure 15:
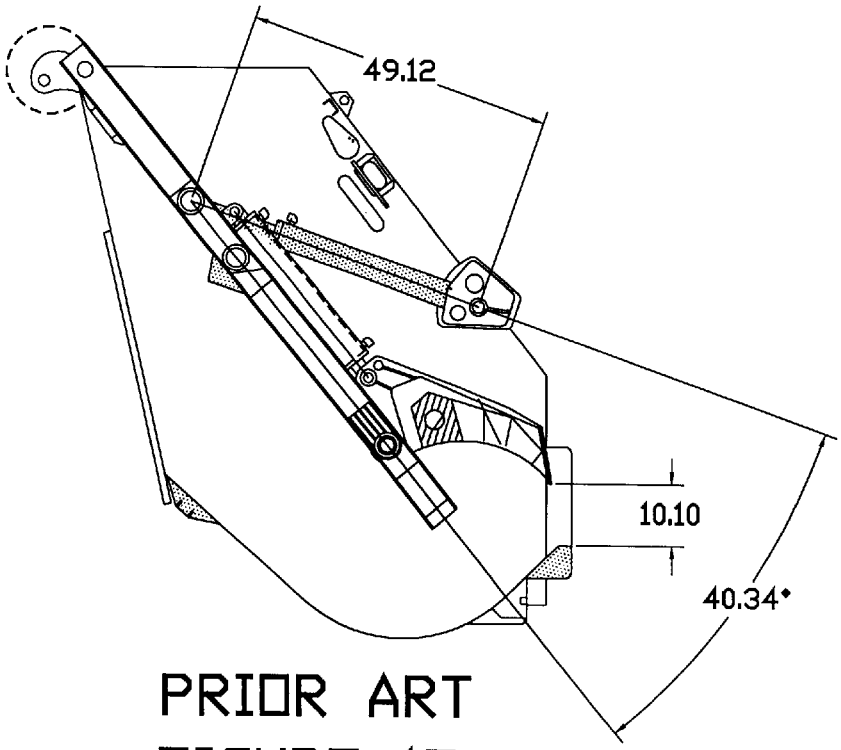
PRIOR ART FIGURE 15
FIG. 15 is a side view of a prior art single track assembly, with the second sidewall removed, illustrating the increased angle between the packer actuator and the track as compared to the preferred embodiment of FIG. 13.

FIGS. 13 and 15 illustrate the carrier in a lowered position. Again, the distance between the ends of the packer actuator are identical. However, the angle between the packer actuator and the tracks of the dual track assembly is substantially less than the same angle on the conventional single-track assembly. Again, FIGS. 13 and 15 demonstrate the substantial alignment of the packer actuator and the tracks of the dual track assembly as compared to the conventional single track assembly.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A dual track handling assembly for refuse collection equipment having a hopper for receiving refuse, said hopper being defined in part by a first sidewall and an oppositely disposed second sidewall, said assembly comprising:

(a) a first lower track and a second lower track, with each lower track having a first end, a second end and a longitudinal axis, said first lower track being mounted on the first sidewall of the hopper and said second lower track being mounted on the second sidewall of the hopper so that the longitudinal axis of the first lower track is generally parallel to the longitudinal axis of the second lower track;

(b) a first upper track and a second upper track, with each upper track having a first end, a second end, and a longitudinal axis, said first upper track being mounted on the first sidewall of the hopper and said second upper track being mounted on the second sidewall of the hopper so that the longitudinal axis of the first upper track is generally parallel to the longitudinal axis of the second upper track;

wherein the longitudinal axes of the first and second lower tracks define a plane that is substantially parallel to a plane defined by the longitudinal axes of the first and second upper tracks;

(c) a first lower track shoe which is adapted to be received in the first lower track and to move between the first end and the second end of the first lower track, and a second lower track shoe which is adapted to be received in the second lower track and to move between the first end and the second end of the second lower track;

(d) a first upper track shoe which is adapted to be received in the first upper track and to move between the first end and the second end of the first upper track, and a second upper track shoe which is adapted to be received in the second upper track and to move between the first end and the second end of the second upper track;

(e) a carrier having a lower track end that is attached to a lower track shoe, an upper track end that is attached to an upper track shoe, and a lower side that is substantially parallel to the longitudinal axes of the lower and upper tracks within which said lower and upper track shoes are received, said carrier being adapted to maintain a fixed spaced relationship between the upper track shoe and the lower track shoe as the shoes move in their respective tracks;

(f) a blade that is pivotally connected to the carrier, said blade being adapted to pivot between an open position and a closed position;

(g) a packer actuator that is adapted to move the upper track shoes between the first and second ends of their respective upper tracks;

(h) a blade actuator that is connected to the blade and adapted to pivot the blade between the open position and the closed position;

(i) a deflector that is mounted between the sidewalls of the hopper so as to be substantially parallel to the plane defined by the longitudinal axes of the first and second lower tracks;

wherein the lower side of the carrier is adapted to substantially bear against at least a portion of the deflector when the lower track shoe that is attached to the lower track end moves from the first end of the lower track within which said lower track shoe is received to the second end of said lower track.

2. The assembly of claim 1 wherein the lower track includes a removably attached face plate.

3. The assembly of claim 1 wherein the second upper end of the upper track is open.

4. The assembly of claim 1 wherein the deflector is provided with a baffle that is adapted to direct refuse away from the assembly.

5. The assembly of claim 1 wherein the blade actuator is provided with a pressure gauge that is adapted to determine the pressure level in the blade actuator.

6. The assembly of claim 1 wherein the blade actuator is mounted so as to extend when the blade is pivoted from the open position to the closed position.

7. The assembly of claim 1 wherein the packer actuator is mounted so as to extend when the upper track shoes are moved from the second end to the first end of the upper track within which such shoes are received.

8. The assembly of claim 1 wherein the upper track shoe is substantially enclosed within the upper track.

9. The assembly of claim 1 which includes:

(a) a first carrier having a lower track end that is attached to the first lower track shoe, an upper track end that is attached to the first upper track shoe, and a lower side that is substantially parallel to the longitudinal axis of the first lower track, said carrier being adapted to maintain a fixed spaced relationship between the first upper track shoe and the first lower track shoe as the shoes move in their respective tracks; and (b) a second carrier having a lower track end that is attached to the second lower track shoe, an upper track end that is attached to the second upper track shoe, and a lower side that is substantially parallel to the longitudinal axis of the second lower track, said carrier being adapted to maintain a fixed spaced relationship between the second upper track shoe and the second lower track shoe as the shoes move in their respective tracks.

10. The assembly of claim 9 which includes a first packer actuator that is adapted to move the first upper track shoe between the first and second ends of the first upper track, and a second packer actuator that is adapted to move the second upper track shoe between the first and second ends of the second upper track.

11. The assembly of claim 9 which includes a support plate that is mounted between the first carrier and the second carrier so that said support plate is substantially parallel to the deflector.

12. A dual track handling assembly for refuse collection equipment having a hopper for receiving refuse, said hopper being defined in part by a first sidewall and an oppositely disposed second sidewall, said assembly comprising:

(a) a first lower track and a second lower track, with each lower track having a first end, a second end and a longitudinal axis, said first lower track being mounted on the first sidewall of the hopper and said second lower track being mounted on the second sidewall of the hopper so that the longitudinal axis of the first lower track is generally parallel to the longitudinal axis of the second lower track;

(b) a first upper track and a second upper track, with each upper track having a first end, a second end, and a longitudinal axis, said first upper track being mounted on the first sidewall of the hopper and said second upper track being mounted on the second sidewall of the hopper so that the longitudinal axis of the first upper track is generally parallel to the longitudinal axis of the second upper track;

wherein the longitudinal axes of the first and second lower tracks define a plane that is substantially parallel to a plane defined by the longitudinal axes of the first and second upper tracks;

(c) a first lower track shoe which is adapted to be received in the first lower track and to move between the first end and the second end of the first lower track, and a second lower track shoe which is adapted to be received in the second lower track and to move between the first end and the second end of the second lower track;

(d) a first upper track shoe which is adapted to be received in the first upper track and to move between the first end and the second end of the first upper track, and a second upper track shoe which is adapted to be received in the second upper track and to move between the first end and the second end of the second upper track;

(e) a first carrier having a lower track end that is attached to the first lower track shoe, an upper track end that is attached to the first upper track shoe, and a lower side that is substantially parallel to the longitudinal axis of the first lower track, said carrier being adapted to maintain a fixed spaced relationship between the first upper track shoe and the first lower track shoe as the shoes move in their respective tracks;

(f) a second carrier having a lower track end that is attached to the second lower track shoe, an upper track end that is attached to the second upper track shoe, and a lower side that is substantially parallel to the longitudinal axis of the second lower track, said carrier being adapted to maintain a fixed spaced relationship between the second upper track shoe and the second lower track shoe as the shoes move in their respective tracks;

(g) a blade that is pivotally connected to the carriers and adapted to pivot between an open position and a closed position;

(h) a packer actuator that is adapted to move the upper track shoes between the first and second ends of their respective upper tracks;

(i) a blade actuator that is connected to the blade and adapted to pivot the blade between the open position and the closed position;

(j) a deflector that is mounted between the sidewalls of the hopper so as to be substantially parallel to the plane defined by the longitudinal axes of the first and second lower tracks;

wherein the lower side of each carrier is adapted to substantially bear against at least a portion of the deflector when the lower track shoe that is attached to the lower track end moves from the first end of the lower track within which said lower track shoe is received to the second end of said lower track.

13. The assembly of claim 12 which includes:

(a) a first packer actuator that is attached to the first upper track shoe and adapted to move said first upper track shoe between the first and second ends of the first upper track; and (b) a second packer actuator that is attached to the second upper track shoe and adapted to move the second upper track shoe between the first and second ends of the second upper track.

14. The assembly of claim 12 which includes a support plate that is mounted between the first carrier and the second carrier so that said support plate is substantially parallel to the deflector.

* * * * *